United States Patent [19]

Szott et al.

[11] 4,146,595

[45] Mar. 27, 1979

[54] IDLING DEVICE OF CARBURETTOR

[75] Inventors: Ryszard Szott; Wieslaw Wiatrak; Wojciech Trybus, all of Bielsko-Biała, Poland

[73] Assignee: Osrodek Badawczo-Rozwojowy Samochodow Malolitrazowych "Bosmal", Bielsko-Biała, Poland

[21] Appl. No.: 857,668

[22] Filed: Dec. 5, 1977

[30] Foreign Application Priority Data

Dec. 13, 1976 [PL] Poland ..... 194394

[51] Int. Cl.$^2$ ..... F02M 3/04

[52] U.S. Cl. ..... 261/41 D; 261/121 B; 261/DIG. 19; 261/DIG. 78; 123/97 B; 123/124 R

[58] Field of Search .... 261/DIG. 19, 41 D, DIG. 78, 261/121 B; 123/97 B, 124 R

[56] References Cited

U.S. PATENT DOCUMENTS

| | | | |
|---|---|---|---|
| 2,036,205 | 4/1936 | Ericson | 261/41 D |
| 2,726,073 | 12/1955 | Seld | 261/DIG. 78 |
| 3,590,793 | 7/1971 | Masaki | 123/97 B |
| 3,931,369 | 1/1976 | Dale et al. | 261/41 D |

FOREIGN PATENT DOCUMENTS

| | | | |
|---|---|---|---|
| 2053991 | 5/1972 | Fed. Rep. of Germany | 261/DIG. 78 |
| 2307140 | 5/1976 | France | 261/DIG. 19 |
| 558884 | 2/1975 | Switzerland | 261/41 D |
| 405346 | 2/1934 | United Kingdom | 261/41 D |
| 1217948 | 1/1971 | United Kingdom | 261/DIG. 19 |

*Primary Examiner*—Tim R. Miles

*Attorney, Agent, or Firm*—Haseltine, Lake & Waters

[57] ABSTRACT

An idling device for a carburettor having an emulsion channel with a feed nozzle, most advantageously, a de Laval nozzle, constituting the smallest section size of the emulsion channel and a concentric port surrounding the nozzle which feeds additional air from over the throttle of the carburettor by a connection channel. The emulsion channel possesses a measurement section controlled by a needle which feeds additional air from the connection channel and at times an inlet of air from the connection channel for blocking fuel outflow. The air inlet is opened by a valve when the negative pressure under the throttle is higher than the negative pressure during idling of the engine.

4 Claims, 1 Drawing Figure

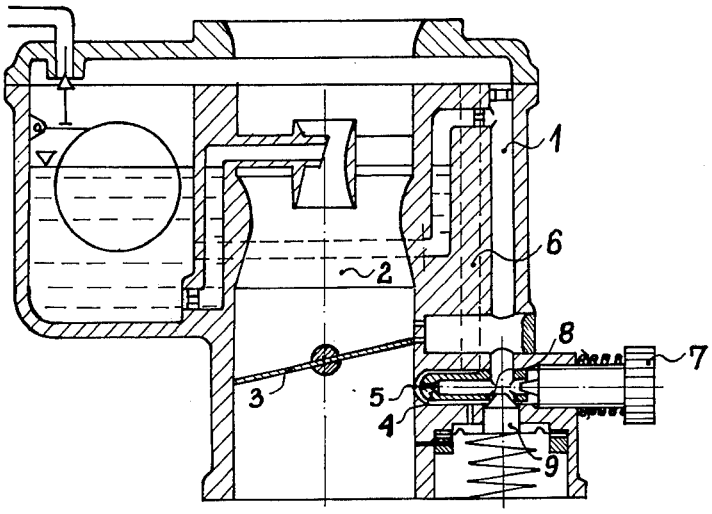
1
2
3
4
5
6
7
8
9

IDLING DEVICE OF CARBURETTOR

FIELD OF THE INVENTION

The invention relates to an idling device of a carburettor, employed in internal combustion engines with spark ignition.

PRIOR ART

In the known state of engineering, there are Polish patent Applications Nos. P. 192084 and P. 193026. Also known are constructions in which the emulsion channel opens via a nozzle into the carburettor proximate the choke, for example, Federal Republic of Germany Pat. No. 1816232.

SUMMARY OF THE INVENTION

An object of the invention is to provide an idling device for a carburettor, enabling correct combustion of the mixture with excess air, equipped with a fuel economizer.

This object has been accomplished in the device according to the invention by a construction in which the conventional emulsion channel, advantageously of constant section, leading to the carburettor choke under the throttle, is, most advantageously provided with a de Lavel nozzle at its end, constituting the smallest section of the emulsion channel, and around which is a concentric port, performing the function of a measurement section, connected through a channel with the carburettor choke above the throttle. The device possesses an air-fuel ratio control during idling in the form of a regulated measurement section in an additional air feed from oer the throttle to the emulsion channel nozzle, or through a section change of aforesaid concentric port.

The device according to the invention is furthermore equipped with a valve governed by the negative pressure in the carburettor choke under the throttle, which during higher negative pressure than during idling of the engine, opens an additional air inlet from the channel connected with the carburettor choke to the emulsion channel, for blocking fuel outflow.

The device according to the invention enables a correct combustion of mixtures with excess air, enables easy control of the air-fuel ratio of such mixtures, and enables further in the case of coasting conditions when the braking effect of the engine is used to shut of the mixture inflow to the engine, thus limiting emission of toxic compounds to the atmosphere and limiting fuel consumption.

BRIEF DESCRIPTION OF THE DRAWING

The sole FIGURE of the drawing is a cross-sectional view through a carburettor with the idling device of the invention.

DETAILED DESCRIPTION

In the drawing there is seen an emulsion channel 1, most advantageously constant section, and ended with a nozzle 4 at the outlet to the carburettor choke 2, under the throttle 3, most advantageously a de Laval nozzle, which constitutes the smallest section of the emulsion channel 1. Around the nozzle 4 there is a concentric port 5, which can be controlled, and acts as measurement section connected by a channel 6 with carburettor choke 2, over the throttle 3, for causing secondary expansion of the mixture, sucked in by the engine.

Emulsion channel 1 is provided with a needle 7 for additional air feeding, to control the air-fuel ratio of the mixture during idling.

In variants of the invention, this control can be carried out through section change of the fuel supply or air supply to the emulsion channel 1, or — as described above — through control of the section of the concentric port 5. Emulsion channel 1 is also equipped with an inlet 8 for additional air, closed by valve 9, which opens when the negative pressure in carburettor choke 2, under throttle 3, is higher than during idling of the engine, thus blocking fuel outflow to emulsion channel 1, whereas action of the valve 9 is regulated to the negative pressure level.

As seen in the drawing, the valve 9 is supported by a diaphragm 10 bounding chamber 11 which opens into the choke below the throttle; a spring 12 acts on the valve 9 to urge the same to its closed position in inlet 8. The inlet 8 has a diameter comparable to that of emulsion channel 1 and is relatively large compared to the size of the nozzle 4.

The valve 9 includes a conical section 9A having a smaller diameter end engageable with inlet 8 and a larger diameter end 9B with a cylindrical extension 9C guidably supported in the body of the carburettor.

The space 13 above the diaphragm 10 is vented at 14 to port 5.

What we claim is:

1. An idling device for a carburettor having a throttle, a choke in which the throttle is disposed and an emulsion channel with a nozzle leading into the choke under the throttle, said idling device comprising a concentric port surrounding the nozzle, an air channel connected to said port and opening into said choke above the throttle for supply of air to said choke below the throttle via said port, a secondary air inlet connected to said nozzle, an adjustment needle controlling flow of secondary air to said nozzle, an additional air inlet connecting said port and said emulsion channel, said additional air inlet being of comparable diameter to said emulsion channel and of relatively large diameter compared to the size of said nozzle, a valve in said further air inlet controlling communication between said port and said emulsion channel, and regulating means acting on said valve to open the valve as the negative pressure in the choke under the throttle exceeds the negative pressure during idling to block fuel outflow to said nozzle from said emulsion channel.

2. An idling device as claimed in claim 1 wherein said nozzle is a De Laval nozzle constituting the smallest section leading from the emulsion channel to the choke.

3. An idling device as claimed in claim 1 wherein the means acting on the valve comprises a spring urging the valve to closed position, a chamber connected to the choke beneath the throttle, and a diaphragm bounding said chamber, and supporting said valve for applying the negative pressure to the valve to open the same against the opposition of the spring.

4. An idling device as claimed in claim 1 wherein said valve includes a conical section having a smaller diameter end engageable with said additional air inlet and a larger diameter end with a cylindrical extension whose diameter is the same as said larger diameter, said carburettor including a body in which said channels and port are formed, said cylindrical extension of said valve being guidably supported in said body.

* * * * *